US005391543A

United States Patent [19]

Higaki et al.

[11] Patent Number: 5,391,543

[45] Date of Patent: Feb. 21, 1995

[54] MICROWAVE RESONATOR OF COMPOUND OXIDE SUPERCONDUCTOR MATERIAL HAVING A TUNING ELEMENT WITH A SUPERCONDUCTIVE TIP

[75] Inventors: Kenjiro Higaki; Akihiro Moto; Hideo Itozaki, all of Hyogo, Japan

[73] Assignee: Sumitomo Electric Industries, Ltd., Osaka, Japan

[21] Appl. No.: 910,573

[22] Filed: Jul. 8, 1992

[30] Foreign Application Priority Data

Jul. 8, 1991 [JP] Japan ..... 3-193427
May 22, 1992 [JP] Japan ..... 4-155580

[51] Int. Cl.[6] ..... H01P 7/08; H01B 12/02

[52] U.S. Cl. ..... 505/210; 505/701; 505/866; 333/235; 333/99 S

[58] Field of Search ..... 333/235, 219, 205, 99 S; 505/1, 700, 701, 866, 204, 210

[56] References Cited

U.S. PATENT DOCUMENTS 3,639,857 2/1972 Okoshi et al. ..... 331/107
3,840,828 10/1974 Linn et al. ..... 333/205
3,857,114 12/1974 Minet et al. ..... 505/866 X
3,925,740 12/1975 Steensma ..... 333/24 C X
4,019,161 4/1977 Kimura et al. ..... 333/235 X
4,488,131 12/1984 Griffin et al. ..... 333/205
4,757,285 7/1988 Krause ..... 333/235 X
5,164,358 11/1992 Buck et al. ..... 505/700 X

FOREIGN PATENT DOCUMENTS 0435765 7/1991 European Pat. Off. .

OTHER PUBLICATIONS

Homak et al., "Electricl Behavior of a 31-cm, thin-film YBaCuO Superconducting Microstrip," *Journal of Applied Physics*, vol. 66, No. 10, pp. 5066-5071 (Nov. 15, 1989).

*Primary Examiner*—Benny T. Lee
*Attorney, Agent, or Firm*—Foley & Lardner

[57] ABSTRACT

A microwave resonator includes a superconducting signal conductor formed on a first dielectric substrate, and a superconducting ground conductor formed on a second dielectric substrate. The first dielectric substrate is stacked on the superconducting ground conductor of the second dielectric substrate. A rod is adjustably provided to be able to penetrate into an electromagnetic field created by a microwave propagation through the superconducting signal conductor, so that the resonating frequency $f_0$ of the microwave resonator can be easily adjusted by controlling the position of a tip end of the rod.

14 Claims, 3 Drawing Sheets

MICROWAVE RESONATOR OF COMPOUND OXIDE SUPERCONDUCTOR MATERIAL HAVING A TUNING ELEMENT WITH A SUPERCONDUCTIVE TIP

BACKGROUND OF THE INVENTION

1. Field of the invention

The present invention relates to microwave resonators, and particularly to a novel structure of microwave resonators which have a signal conductor formed of a compound oxide superconducting thin film.

2. Description of Related Art

Electromagnetic waves called "microwaves" or "millimetric waves" having a wavelength in a range of tens of centimeters to millimeters can be theoretically said to be merely a part of an electromagnetic wave spectrum, but in many cases, have been considered as being a special independent field of the electromagnetic wave, since special and unique methods and devices have been developed for handling these electromagnetic waves.

In 1986, Bednorz and Mailer reported $(La, Ba)_2CuO_4$ showing a superconduction state at a temperature of 30K. In 1987, Chu reported $YBa_2Cu_3O_y$ having a superconduction critical temperature on the order of 90K, and in 1988. Maeda reported a so-call bismuth (Bi) type compound oxide superconductor material having a superconduction critical temperature exceeding 100K. These compound oxide superconductor materials can obtain a superconduction condition with cooling using an inexpensive liquid nitrogen. As a result, possibility of actual application of the superconduction technology has been increasingly discussed and studied.

Phenomenon inherent to the superconduction can be advantageously utilized in various applications, and the microwave component is no exception. In general, a microstrip line has an attenuation coefficient that is attributable to a resistance component of the conductor. This attenuation coefficient attributable to the resistance component increases in proportion to a root of a frequency. On the other hand, the dielectric loss increases in proportion to increase of the frequency. However, the loss in a recent microstrip line is almost attributable to the resistance of the conductor in a frequency region not greater than 10 GHz, since the dielectric materials have been improved. Therefore, if the resistance of the conductor in the strip line can be reduced, it is possible to greatly elevate the performance of the microstrip line.

As is well known, the microstrip line can be used as a simple signal transmission line. In addition, if a suitable patterning is applied, the microstrip line can be used as microwave components including an inductor, a filter, a resonator, a delay line, etc. Accordingly, improvement of the microstrip line will lead to improvement of characteristics of the microwave component. Therefore, various microwave components having a signal conductor formed of an oxide superconductor have been proposed.

A typical conventional microwave resonator using the oxide superconductor as mentioned above includes a first substrate provided with a superconducting signal conductor formed of an oxide superconducting thin film patterned in a predetermined shape, and a second substrate having a whole surface provided with a superconducting ground conductor also formed of an oxide superconducting thin film. The first and second substrates are stacked on each other within a metal package, which is encapsulated and sealed with a metal cover The superconducting signal conductor is composed of a resonating superconducting signal conductor, and a pair of superconducting signal launching conductors located at opposite sides of the resonating superconducting signal conductor, separated from the resonating superconducting signal conductor. These superconducting signal conductor and the superconducting ground conductor can be formed of an superconducting thin film of for example an Y-Ba-Cu-O type compound oxide.

The microwave resonator having the above mentioned construction has a specific resonating frequency $f_0$ in accordance with the characteristics of the superconducting signal conductor, and can be used for frequency control in a local oscillator of microwave communication instruments, and for other purposes.

However, one problem has been encountered in which the resonating frequency $f_0$ of the microwave resonator actually manufactured by using the oxide superconductor is not necessarily consistent with a designed value. Namely, in this type microwave resonator, a slight variation in characteristics of the oxide superconducting thin film and a slight error in assembling cause an inevitable dispersion in the characteristics of the microwave resonator.

SUMMARY OF THE INVENTION

Accordingly, it is an object of the present invention to provide a microwave resonator which has overcome the above mentioned defect of conventional resonators.

Another object of the present invention is to provide a novel microwave resonator which can easily adjust the resonating frequency of the microwave resonator in order to compensate for the dispersion in the characteristics of the microwave resonator.

The above and other objects of the present invention are achieved in accordance with the present invention by a microwave resonator including a dielectric substrate, a patterned superconducting signal conductor provided at one surface of the dielectric substrate and a superconducting ground conductor provided at the other surface of the dielectric substrate, the superconducting signal conductor and the superconducting ground conductor being formed of an oxide superconducting thin film, the resonator further including a rod adjustably positioned to be able to penetrate into an electromagnetic field created by a microwave propagation through the superconducting signal conductor, so that the resonating frequency $f_0$ of the microwave resonator can be easily adjusted by adjusting the position of a tip end of the rod.

Preferably, the rod is formed of a material selected from the group consisting of an electric conductor such a metal, a dielectric material and a magnetic material.

As seen from the above, the microwave resonator in accordance with the present invention is characterized in that it has the means for adjusting its resonating frequency $f_0$.

When a microwave propagates through the microstrip line, an electric field is created between the ground conductor and the signal conductor, and at the same time, a magnetic field is created around the signal conductor. If a conductor piece, a dielectric piece or a magnetic piece is inserted into the electromagnetic field thus created, electromagnetic characteristics of the resonator, in particular, the resonating frequency of the resonator is caused to be changed. Therefore, the resonating frequency $f_0$ of the microwave resonator can be easily adjusted by controlling the amount of penetration of the rod (formed of a conductor, a dielectric material or a magnetic material) into the electromagnetic field.

As mentioned above, the rod for adjusting the resonating frequency $f_0$ of the microwave resonator can be formed of a conductor, a dielectric material or a magnetic material, but is not limited in shape and in composition of the material. Therefore, the rod can be easily mounted on the microwave resonator by utilizing a package or a cover of the microwave resonator. In this connection, the conductor piece formed of a superconductor material can be advantageously used in order to prevent decrease of the Q factor of the resonator.

The superconducting signal conductor layer and the superconducting ground conductor layer of the microwave resonator in accordance with the present invention can be formed of thin films of general oxide superconducting materials such as a high critical temperature (high-Tc) copper-oxide type oxide superconductor material typified by a Y-Ba-Cu-O type compound oxide superconductor material, a Bi-Sr-Ca-Cu-O type compound oxide superconductor material, and a Tl-Ba-Ca-Cu-O type compound oxide superconductor material. In addition, deposition of the oxide superconducting thin film can be exemplified by a sputtering technique, a laser evaporation technique, etc.

The substrate can be formed of a material selected from the group consisting of MgO, $SrTiO_3$, $NdGaO_3$, $Y_2O_3$, $LaAlO_3$, $LaGaO_3$, $Al_2O_3$, and $ZrO_2$. However, the material for the substrate is not limited to these materials, and the substrate can be formed of any oxide material which does not diffuse into the high-Tc copper-oxide type oxide superconductor material used, and which substantially matches in crystal lattice with the high-Tc copper-oxide type oxide superconductor material used, so that a clear boundary is formed between the oxide insulator thin film and the superconducting layer of the high-Tc copper-oxide type oxide superconductor material. From this viewpoint, it can be said to be possible to use an oxide insulating material conventionally used for forming a substrate on which a high-Tc copper-oxide type oxide superconductor material is deposited.

A preferred substrate material includes a MgO single crystal, a $SrTiO_3$ single crystal, a $NdGaO_3$ single crystal substrate, a $Y_2O_3$, single crystal substrate, a $LaAlO_3$ single crystal, a $LaGaO_3$ single crystal, a $Al_2O_3$ single crystal, and a $ZrO_2$ single crystal.

For example, the oxide superconductor thin film can be deposited by using, for example, a (100) surface of a MgO single crystal substrate, a (110) surface or (100) surface of a $SrTiO_3$ single crystal substrate and a (001) surface of a $NdGaO_3$ single crystal substrate, as a deposition surface on which the oxide superconductor thin film is deposited.

The above and other objects, features and advantages of the present invention will be apparent from the following description of preferred embodiments of the invention with reference to the accompanying drawings However, the examples explained hereinafter are only for illustration of the present invention, and therefore, it should be understood that the present invention is in no way limited to the following examples.

DESCRIPTION OF THE PREFERRED EMBODIMENTS

Figure 1:
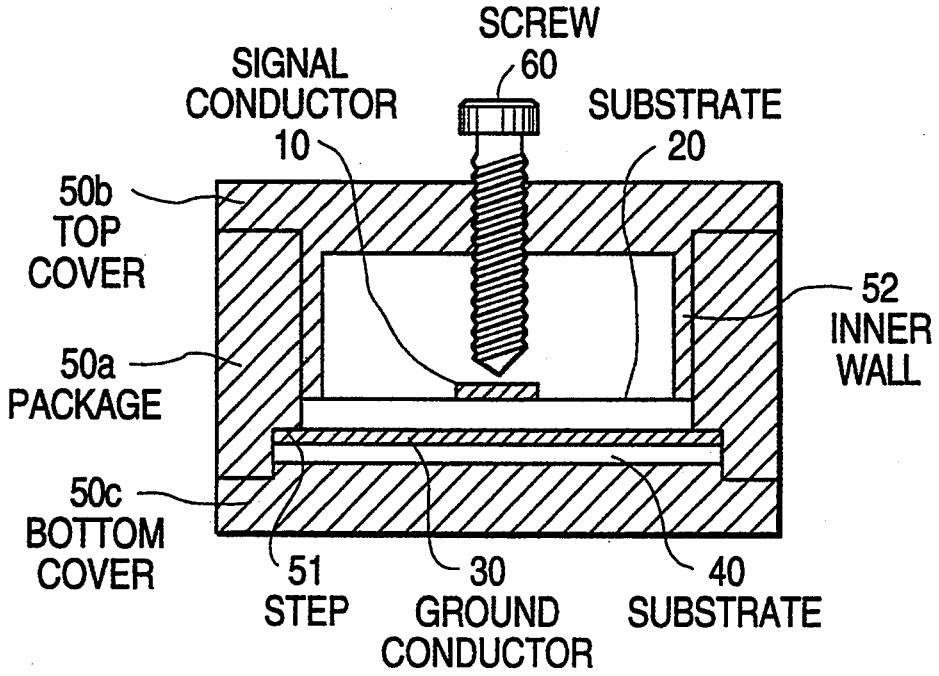
FIG. 1 is a diagrammatic sectional view showing a first embodiment of the microwave resonator in accordance with the present invention.

Referring to FIG. 1, there is shown a diagrammatic sectional view showing a first embodiment of the microwave resonator in accordance with the present invention.

The shown microwave resonator includes a first substrate 20 formed of a dielectric material and having an upper surface formed with a superconducting signal conductor 10 constituted of an oxide superconducting thin film patterned in a predetermined shape mentioned hereinafter, and a second substrate 40 formed of a dielectric material and having an upper surface fully covered with a superconducting ground conductor 30 also formed of an oxide superconducting thin film. The first and second substrates 20 and 40 are stacked on each other in such a manner that an all lower surface of the first substrate 20 is in contact with the superconducting ground conductor 30. The stacked assembly of the first and second substrates 20 and 40 is located within a hollow package **50*a* of a square section having upper and lower open ends. The hollow package 50*a* is encapsulated and sealed at its upper and lower ends with a top cover 50*b* and a bottom cover 50*c*, respectively. The second substrate 40 lies on an upper surface of the bottom cover 50*c***.

Since the oxide superconducting thin film 10 is formed on the first substrate 20 and the oxide superconducting thin film 30 is formed on the second substrate 40 independently of the first substrate 20, it is possible to avoid deterioration of the oxide superconducting thin films, which would occur when a pair of oxide superconducting thin films are sequentially deposited on one surface of a substrate and then on the other surface of the same substrate.

As shown in FIG. 1, the second substrate 40 is larger in size than the first substrate 20, and an inner surface of the package **50*a* has a step 51 to comply with the difference in size between the first substrate 20 and the second substrate 40. Thus, the second substrate 40 is sandwiched and fixed between the upper surface of the bottom cover 50*b* and the step 51 of the package 50*a*, in such a manner that the superconducting ground conductor 30 formed on the second substrate 40 is at its periphery in contact with the step 51 of the package 50*a***.

In addition, the top cover **50*b* has an inner wall 52 extending downward along the inner surface of the package 50*a* so as to abut against the upper surface of the first substrate 20, so that the first substrate 20 is forcibly pushed into a close contact with the the superconducting ground conductor 30 of the second substrate 40, and held between the second substrate 40 and a lower end of the inner wall 52 of the top cover 50***b*.

In addition, actually, lead conductors (not shown) are provided to penetrate through the package 50*a* or the cover 50*b* in order to launch microwave into the signal conductor 10.

The shown microwave resonator also includes a screw 60, which is formed of brass and which is screwed through the top cover 50*b* of the package 50*a* to extend perpendicular to the the signal conductor 10 and to be aligned to a center of the signal conductor 10. By rotating a head of the screw 60, it is possible to cause a tip end of the screw 60 to approach and move apart from the signal conductor 10.

Figure 2:
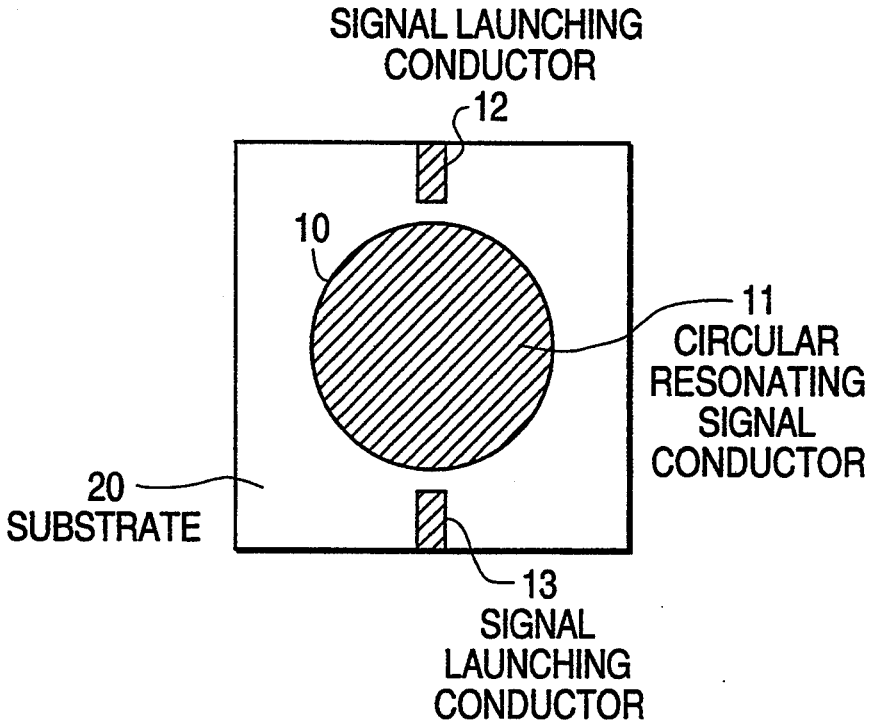
FIG. 2 is a pattern diagram showing the signal conductor of the superconducting microwave resonator shown in FIG. 1.

FIG. 2 shows a pattern of the superconducting signal conductor 10 formed on the first substrate 20 in the microwave resonator shown in FIG. 1.

As shown in FIG. 2, on the first substrate 20 there are formed a circular superconducting signal conductor 11 to constitute a resonator, and a pair of superconducting signal conductors 12 and 13 launching and picking up the microwave to and from the superconducting signal conductor 11. These superconducting signal conductors 11, 12 and 13 and the superconducting ground conductor 30 on the second substrate 40 (FIG. 1) can be formed of an superconducting thin film of for example an Y-Ba-Cu-O type compound oxide.

The microwave resonator having the above mentioned construction is used by cooling the superconducting signal conductor 10 and the superconductor ground conductor 30 so that the conductors 10 and 30 behave as superconductors. On the other hand, by handling the screw 60, the electromagnetic characteristics of the resonating circuit constituted of the superconducting signal conductor 10, the superconducting ground conductor 30, the package 50*a* and the covers 50*b* and 50*c* can be modified, and the resonating frequency $f_0$ of the microwave resonator can be adjusted.

A microwave resonator having a construction shown in FIG. 1 was actually manufactured.

The first substrate 20 was formed of a square MgO substrate having each side of 18 mm and a thickness of 1 min. The superconducting signal conductor 10 was formed of a Y-Ba-Cu-O compound oxide thin film having a thickness of 5000 Å. This Y-Ba-Cu-O type compound oxide superconducting thin film was deposited by a sputtering. The deposition condition was as follows:

Target: $Y_1Ba_2Cu_3O_{7-x}$
Sputtering gas: Ar containing 20 tool % of $O_2$
Gas pressure: 0.5 Torr
Substrate Temperature: 620° C.
Film thickness: 5000 Å

The superconducting signal conductor 10 thus formed was patterned as follows so as to constitute the resonator: The superconducting signal conductor 11 is in the form of a circle having a diameter of 12 mm, and the pair of superconducting signal launching conductors 12 and 13 have a width of 1.0 mm and a length of 1.5 mm. A distance or gap between the superconducting signal conductor 11 and each of the superconducting signal launching conductors 12 and 13 is 1.5 mm.

On the other hand, the second substrate 40 was formed of square MgO substrates having a thickness of 1 mm and each side of 20 mm. The superconducting ground conductor 30 was formed of a Y-Ba-Cu-O compound oxide thin film having a thickness of 5000 Å, in a sputtering similar to that for deposition of superconducting signal conductor 10.

The above mentioned substrates 20 and 40 were located within the square-section hollow package 50*a* formed of brass, and opposite openings of the package 50*a* were encapsulated and sealed with the covers 50*b* and 50*c* also formed of brass.

In addition, a threaded hole for receiving the screw 60 is formed at a center of the upper cover 50*b*, and the screw 60 formed of M4(ISO) brass is screwed into the threaded hole.

Figure 3:
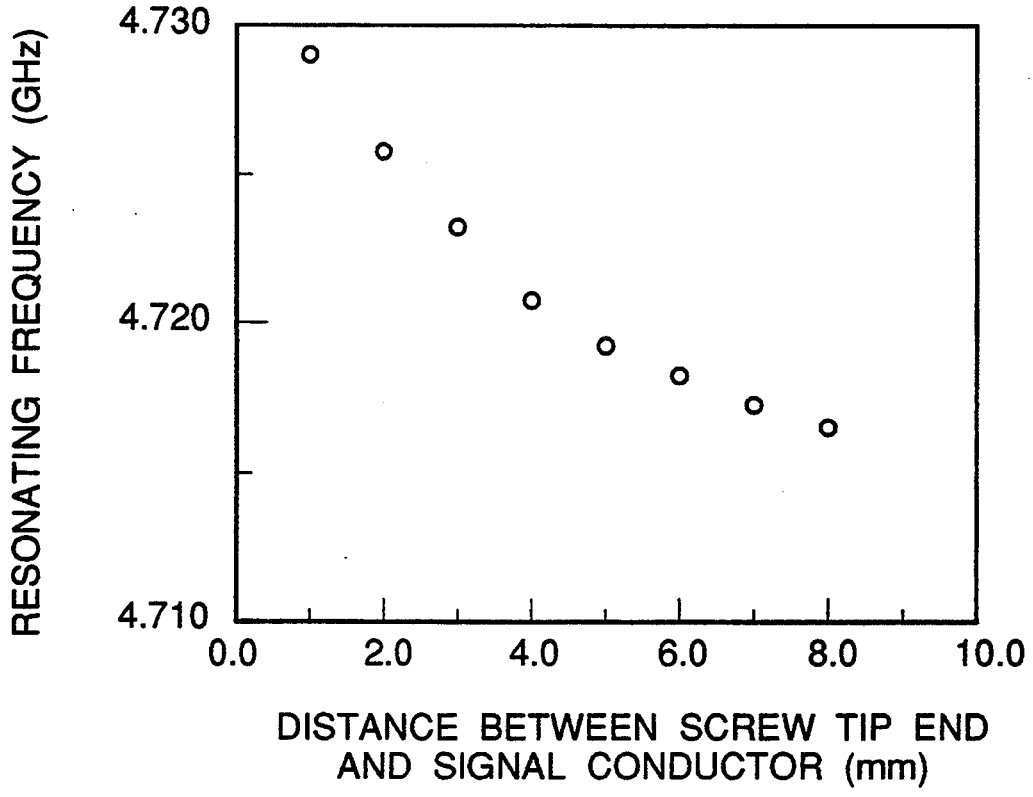
FIG. 3 is a graph showing the characteristics of the superconducting microwave resonator shown in FIG. 1.

For the superconducting microwave resonator thus formed, a frequency characteristics of the transmission power was measured by use of a network analyzer. The resonating frequency at 77K is as shown in FIG. 3.

Figure 4:
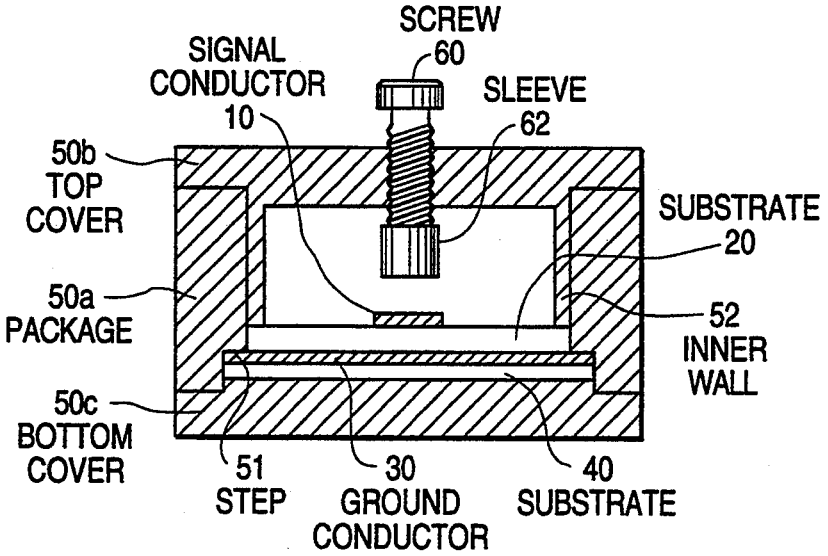
FIG. 4 is a diagrammatic sectional view showing a second embodiment of the microwave resonator in accordance with the present invention.

Referring to FIG. 4, there is shown a diagrammatic sectional view showing a second embodiment of the microwave resonator in accordance with the present invention. In FIG. 4, elements similar to those shown in FIG. 1 are given the same Reference Numerals, and therefore, explanation thereof will be omitted.

As seen from comparison between FIGS. 1 and 4, the second embodiment has basically the same construction as that of the first embodiment, except that the tip end of the screw 60 is provided with a superconductor piece 61 (not shown in FIG. 4) and a sleeve 62 for holding and covering the superconductor piece 61 on the tip end of the screw 60.

Figure 5:
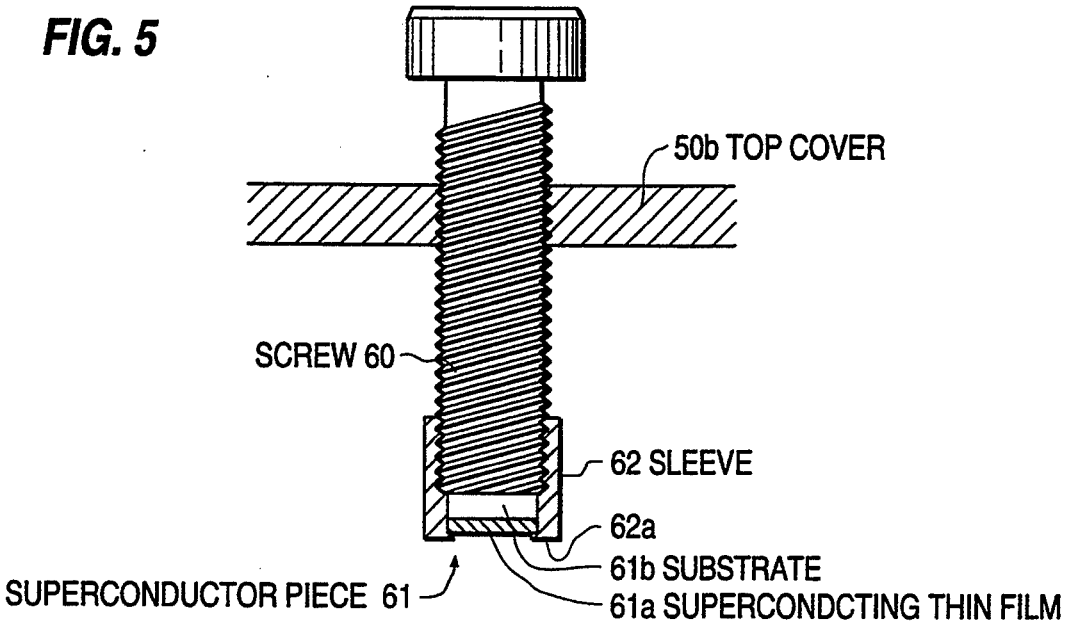
FIG. 5 is an enlarged diagrammatic sectional view of the screw incorporated in the superconducting microwave resonator shown in FIG. 4.

FIG. 5 is an enlarged diagrammatic sectional view of the screw 60 incorporated in the superconducting microwave resonator shown in FIG. 4.

As shown in FIG. 5, the superconductor piece 61 has a substrate 61*b* in the form of a circular disc having one surface coated with an oxide superconducting thin film 61*a*, which is formed of the same material as those of the superconducting conductor 10 or 30. The sleeve 62 is formed of brass, which is the same material as that of the screw 60. An upper portion of the sleeve 62 has a female-threaded inner surface for mating with the lower end of the screw 60, as shown in FIG. 5. A lower end of the sleeve 62 has an inner flange 62*a* defining an opening having an inner diameter slightly smaller than an outer diameter of the superconductor piece 61. Therefore, the superconductor piece 61 is located on the tip end of the screw 60 in such a manner that the oxide superconducting thin film 61*a* is directed toward the outside, and then, the sleeve 62 is screwed over the tip end of the screw 60 in such a manner that the superconductor piece 61 is fixed to the tip end of the screw 60 and the inner flange 62*a* of the sleeve 62 is brought into contact with the oxide superconducting thin film 61*a*. Thus, the oxide superconducting thin film 61*a* is electrically connected to the ground conductor 30 through the sleeve 62, the screw 60, the top cover 50*b*, and the package 50*a*, all of which are formed of brass.

With the above mentioned arrangement, by handling the screw 60 externally of the microwave resonator so as to change the amount of penetration of the superconductor piece 61, the electromagnetic characteristics of the resonating circuit constituted of the superconducting signal conductor 10, the superconducting ground conductor 30, the package 50*a* and the covers 50*b* and 50*c* can be modified, and the resonating frequency $f_0$ of the microwave resonator can be adjusted.

A microwave resonator having a construction shown in FIGS. 4 and 5 was actually manufactured, and the characteristics was also measured.

The portions of the second embodiment other than the superconductor piece 61 and the sleeve 62 was formed in the same manner as that for manufacturing the first embodiment.

The superconductor piece 61 was formed by cutting out a circular disc having a diameter of 8 ram, from a MgO substrate 61*b* having a thickness of 1 mm and deposited with a Y-Ba-Cu-O compound oxide thin film 61*a*. The deposition method and conditions for forming the Y-Ba-Cu-O compound oxide thin film 61*a* and the thickness of the Y-Ba-Cu-O compound oxide thin film 61*a* are the same as those for forming the signal conductor 10.

The sleeve 62 was manufactured by machining a circular brass rod into a tubular member having such a size that the female-threaded portion has an inner diameter of 10 mm, a tip end portion for receiving the MgO substrate 61*b* has an inner diameter of 8 mm, and the inner flange 62*a* of the tip end for holding the MgO substrate 61*b* has an inner diameter of 7.5 mm.

In order to evaluate the performance of the microwave resonator of the second embodiment, another microwave resonator using an Au thin film in place of the Y-Ba-Cu-O compound oxide thin film 61*a* was manufactured as a comparative sample under the same manufacturing conditions as those for manufacturing the microwave resonator of the second embodiment. The Au thin film formed on the substrate 61*b* has a thickness of 10 μm.

The following shows the Q factor and the resonating frequency of the two microwave resonators when the distance between the tip end of the sleeve 62 and the signal conductor 10 is adjusted at 8 mm and 2 mm, respectively.

| | Distance between the screw and the signal conductor | | | |
|---|---|---|---|---|
| | 8 mm | | 2 mm | |
| | resonating frequency | Q factor | resonating frequency | Q factor |
| Y—Ba—Cu—O thin film | 4.165 GHz | 13500 | 4.732 GHz | 13800 |
| Au thin film | 4.166 GHz | 12800 | 4.735 GHz | 6100 |

As seen from the above, if the conductor piece penetrating into the inside of the microwave resonator is formed of the superconductor, the Q factor is stable regardless of change of the resonating frequency.

As mentioned above, the microwave resonator in accordance with the present invention is so constructed as to be able to easily adjust the resonating frequency $f_0$. In addition, if an appropriate conductor piece is used, the resonating frequency can be adjusted while maintaining the Q factor at a stable value.

Accordingly, the microwave resonator in accordance with the present invention can be effectively used in a local oscillator of microwave communication instruments, and the like.

The invention has thus been shown and described with reference to the specific embodiments. However, it should be noted that the present invention is in no way limited to the details of the illustrated structures but changes and modifications may be made within the scope of the appended claims.

We claim:

1. A microwave resonator comprising:

a first dielectric substrate;

a patterned superconducting signal conductor provided on one surface of said first dielectric substrate and a superconducting ground conductor provided adjacent to an opposite surface of said first dielectric substrate, said superconducting signal conductor and said superconducting ground conductor being respectively comprised of an oxide superconducting thin film; and a rod, adjustably positioned to be able to penetrate into an electromagnetic field created when a microwave signal is applied to and propagated through said superconducting signal conductor, wherein a resonating frequency $f_0$ of said microwave resonator is adjustable by controlling a distance between a tip end of said rod and said patterned superconducting signal conductor as said rod moves within said electromagnetic field in a direction substantially perpendicular to said one surface of said first dielectric substrate.

2. A microwave resonator claimed in claim 1 wherein said rod comprises a material selected from the group consisting of an electric conductor, a dielectric material and a magnetic material.

3. A microwave resonator comprising:

a first dielectric substrate;

a patterned superconducting signal conductor provided on one surface of said first dielectric substrate and a superconducting ground conductor provided adjacent to an opposite surface of said first dielectric substrate, said superconducting signal conductor and said superconducting ground conductor being respectively comprised of an oxide superconducting thin film; and a rod, adjustably positioned to be able to penetrate into an electromagnetic field created when a microwave signal is applied to and propagated through said superconducting signal conductor, wherein a resonating frequency $f_0$ of said microwave resonator is adjustable by controlling a distance between a tip end of said rod and said patterned superconducting signal conductor, said tip end of said rod including a superconductor piece which is electrically connected to said superconducting ground conductor via said rod.

4. A microwave resonator claimed in claim 3 wherein each of said superconducting signal conductor and said superconducting ground conductor respectively comprises a high critical temperature copper-oxide type oxide superconductor material.

5. A microwave resonator claimed in claim 3 wherein each of said superconducting signal conductor and said superconducting ground conductor respectively comprises a material selected from the group consisting of a Y-Ba-Cu-O type compound oxide superconductor material, a Bi-Sr-Ca-Cu-O type compound oxide superconductor material, and a Tl-Ba-Ca-Cu-O type compound oxide superconductor material.

6. A microwave resonator claimed in claim 3 wherein said first dielectric substrate comprises a material selected from the group consisting of MgO, $SrTiO_3$, $NdGaO_3$, $Y_2O_3$, $LaAlO_3$, $LaGaO_3$, $Al_2O_3$, and $ZrO_2$.

7. A microwave resonator claimed in claim 3 wherein said superconducting signal conductor is disposed on said one surface of said first dielectric substrate, and said superconducting ground conductor is disposed to completely cover an upper surface of a second dielectric substrate, said first dielectric substrate being stacked on said second dielectric substrate in close contact with said superconducting ground conductor of said second dielectric substrate.

8. A microwave resonator comprising:

a first dielectric substrate;

a patterned superconducting signal conductor provided on one surface of said first dielectric substrate and a superconducting ground conductor provided adjacent to an opposite surface of said first dielectric substrate, said superconducting signal conductor and said superconducting ground conductor being respectively comprised of an oxide superconducting thin film;

a rod, adjustably positioned to be able to penetrate into an electromagnetic field created when a microwave signal is applied to and propagated through said superconducting signal conductor, wherein a resonating frequency $f_0$ of said microwave resonator is adjustable by controlling a distance between a tip end of said rod and said patterned superconducting signal conductor, said tip end of said rod including a superconductor piece which is electrically connected to said superconducting ground conductor via said rod, said superconducting signal conductor is disposed on said one surface of said first dielectric substrate, and said superconducting ground conductor is disposed to completely cover an upper surface of a second dielectric substrate, said first dielectric substrate being stacked on said second dielectric substrate in close contact with said superconducting ground conductor of said second dielectric substrate; and a package having a hollow metal member having a top opening and a bottom opening, a top metal cover fitted to said top opening of said hollow metal member, and a bottom metal cover fitted to said bottom opening of said hollow metal member, a stacked assembly comprised of said first dielectric substrate and said second dielectric substrate being located within said package in such a manner that a lower surface of said second dielectric substrate is in contact with an inner surface of said bottom cover, and said superconducting ground conductor is in contact with said hollow metal member, said rod being comprised of a metal screw, said metal screw being screwed through said top cover so that a tip of said metal screw defines said tip end, said tip end being moved toward or apart from said superconducting signal conductor by rotation of said metal screw, said metal screw being electrically connected to said superconducting ground conductor through said top metal cover and said hollow metal member.

9. A microwave resonator claimed in claim 8 wherein said screw has a superconductor piece which is located on the tip end of said screw and which is electrically connected to said screw.

10. A microwave resonator claimed in claim 9 wherein said superconductor piece has a circular substrate having one surface coated with an oxide superconducting thin film, and a metal sleeve having an upper portion with a female-threaded inner surface engaging said tip of said screw and a lower end with an inner flange for holding said circular substrate between said tip of said screw and said inner flange, said inner flange being electrically connected to said oxide superconducting thin film on said circular substrate.

11. A microwave resonator claimed in claim 8 wherein each of said superconducting signal conductor and said superconducting ground conductor respectively comprises a high critical temperature copper-oxide type oxide superconductor material.

12. A microwave resonator claimed in claim 8 wherein each of said superconducting signal conductor and said superconducting ground conductor respectively comprises a material selected from the group consisting of a Y-Ba-Cu-O type compound oxide superconductor material, a Bi-Sr-Ca-Cu-O type compound oxide superconductor material, and a Tl-Ba-Ca-Cu-O type compound oxide superconductor material.

13. A microwave resonator claimed in claim 8 wherein said dielectric substrate comprises a material selected from the group consisting of MgO, $SrTiO_3$, $NdGaO_3$, $Y_2O_3$, $LaAlO_3$, $LaGaO_3$, $Al_2O_3$, and $ZrO_2$.

14. A method of adjusting a resonating frequency $f_0$ of a microwave resonator including a first dielectric substrate and a patterned superconducting signal conductor provided on one surface of said first dielectric substrate and a superconducting ground conductor provided adjacent to an opposite surface of said first dielectric substrate, said superconducting signal conductor and said superconducting ground conductor being respectively comprised of an oxide superconducting thin film, said method comprising the steps of:

propagating an applied microwave signal through said superconducting signal conductor to generate an electromagnetic field; and moving a rod, including a superconducting tip, within said electromagnetic field to adjust said resonating frequency $f_0$ of said microwave resonator by changing a distance between said superconducting tip of said rod and said patterned superconducting signal conductor.

* * * * *